US009982372B2

(12) United States Patent
Liao et al.

(10) Patent No.: US 9,982,372 B2
(45) Date of Patent: May 29, 2018

(54) STRETCH WOVENS WITH A CONTROL YARN SYSTEM

(71) Applicant: INVISTA North America S.à r.l., Wilmington, DE (US)

(72) Inventors: Tianyi Liao, Chadds Ford, PA (US); Raymond S. P. Leung, Shatin (HK); Leonid Nefodov, Bellevue (CH)

(73) Assignee: INVISTA North America S.à.r.l., Wilmington, DE (US)

( * ) Notice: Subject to any disclaimer, the term of this patent is extended or adjusted under 35 U.S.C. 154(b) by 895 days.

(21) Appl. No.: 14/397,832

(22) PCT Filed: Mar. 26, 2013

(86) PCT No.: PCT/US2013/033848
§ 371 (c)(1),
(2) Date: Oct. 29, 2014

(87) PCT Pub. No.: WO2013/148659
PCT Pub. Date: Oct. 3, 2013

(65) Prior Publication Data

US 2015/0133017 A1 May 14, 2015

Related U.S. Application Data

(60) Provisional application No. 61/618,096, filed on Mar. 30, 2012.

(51) Int. Cl.
*D03D 15/08* (2006.01)
*D03D 15/00* (2006.01)
(Continued)

(52) U.S. Cl.
CPC ..... *D03D 15/08* (2013.01); *D02G 3/328* (2013.01); *D03D 1/00* (2013.01); *D03D 15/0027* (2013.01);
(Continued)

(58) Field of Classification Search
None
See application file for complete search history.

(56) References Cited

U.S. PATENT DOCUMENTS 2,448,201 A * 8/1948 Whewell ..... D03C 7/00 139/388
3,169,558 A 2/1965 Aleixo et al.
(Continued)

FOREIGN PATENT DOCUMENTS

EP 1676944 A1 7/2006
GB 1513273 A 6/1978
(Continued)

OTHER PUBLICATIONS

International Search Report and Written Opinion Received for PCT Application No. PCT/US2013/033848, dated Jul. 30, 2013, 7 pages.
(Continued)

*Primary Examiner* — Shawn Mckinnon
(74) *Attorney, Agent, or Firm* — Bridget C. Sciamanna

(57) ABSTRACT

An article including a woven fabric comprising warp yarns and weft yarns, wherein at least one of either the warp yarns or the weft yarns includes: (a) a corespun elastic base yarn having a denier and including staple fiber and an elastic fiber core; and (b) a separate control yarn selected from the group consisting of a single filament yarn, a multiple filament yarn, a composite yarn, and combinations thereof; having a denier greater than zero to about 0.8 times the denier of the corespun elastic base yarn; wherein the woven fabric includes (1) a ratio of corespun base yarn ends to control yarn ends of up to about 6:1; or (2) a ratio of corespun base yarn picks to control yarn picks of up to about 6:1; or (3) both a ratio of corespun base yarn ends to control yarn ends of up to about 6:1; and a ratio of corespun base yarn picks to control yarn picks of up to about 6:1.

20 Claims, 1 Drawing Sheet

(51) Int. Cl.
*D03D 1/00* (2006.01)
*D02G 3/32* (2006.01)

(52) U.S. Cl.
CPC ..... *D03D 15/0094* (2013.01); *D10B 2201/01* (2013.01); *D10B 2321/02* (2013.01); *D10B 2331/02* (2013.01); *D10B 2331/04* (2013.01); *D10B 2501/00* (2013.01); *Y10T 442/3024* (2015.04)

(56) References Cited

U.S. PATENT DOCUMENTS

| | | | | |
|---|---|---|---|---|
| 6,659,139 | B2 | 12/2003 | Laycock et al. | |
| 7,299,828 | B2 | 11/2007 | Liao | |
| 7,762,287 | B2 | 7/2010 | Liao | |
| 8,093,160 | B2 | 1/2012 | Tharpe, Jr. et al. | |
| 2008/0268734 | A1* | 10/2008 | Tharpe ..... | D01H 1/00 442/184 |
| 2009/0191777 | A1 | 7/2009 | Liao | |

FOREIGN PATENT DOCUMENTS

| | | | |
|---|---|---|---|
| JP | 2002-013045 | A | 1/2002 |
| KR | 1020080099548 | A | 11/2008 |
| WO | 2013/0148659 | A1 | 10/2013 |

OTHER PUBLICATIONS

International Preliminary Report and Patentability Report Received for PCT Patent Application No. PCT/US2013/033848, dated Oct. 9, 2014, 6 pages.

* cited by examiner

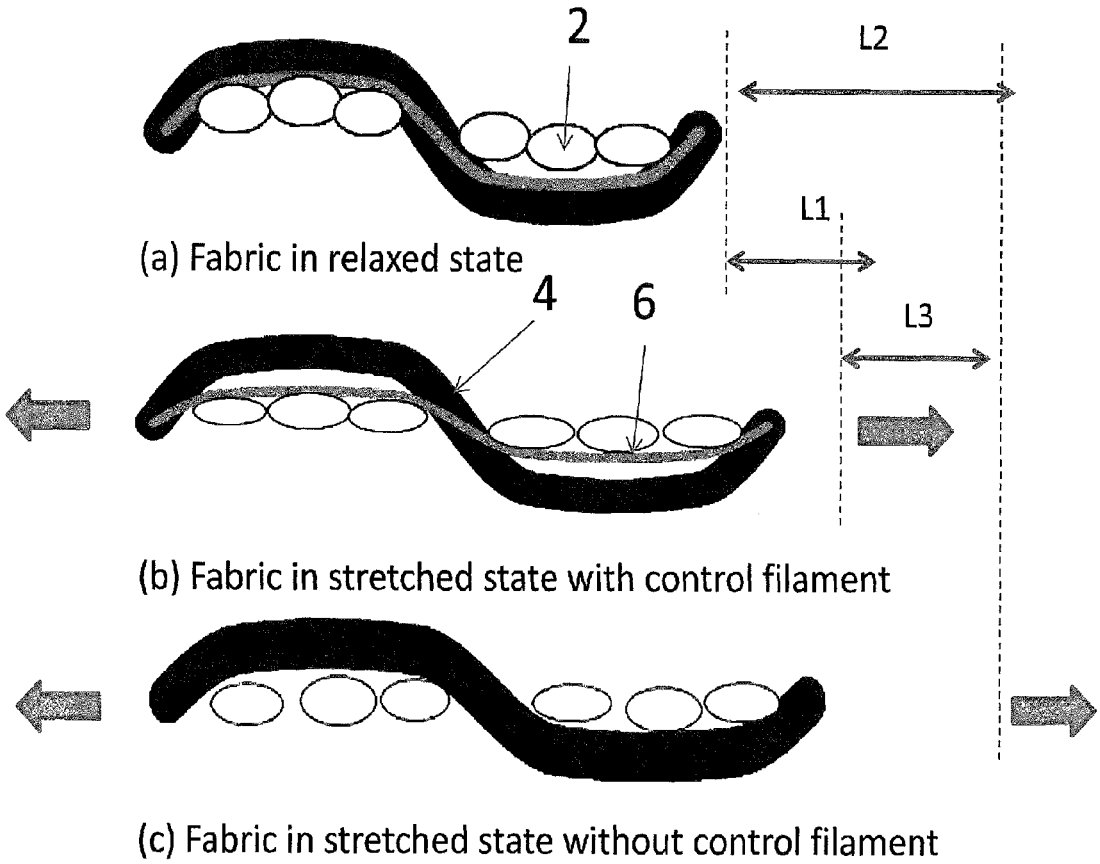
(a) Fabric in relaxed state
(b) Fabric in stretched state with control filament
(c) Fabric in stretched state without control filament

STRETCH WOVENS WITH A CONTROL YARN SYSTEM

BACKGROUND OF THE INVENTION

Field of the Invention

This invention relates to the manufacture of stretch woven fabrics including staple corespun elastic yarn. It specifically relates to the fabrics and methods including a separated control yarn system within stretch fabrics.

Summary of Related Art

Stretch woven fabrics with staple core spun elastic yarn have been on the market for three decades. Textile manufacturers generally understand the importance of the right quality parameters to achieve fabrics acceptable to consumers. However, the industry is still looking for the way to produce stretch fabrics with better recovery power. A typical quality issue for current stretch fabrics is that fabrics failed to return to their original size after wearing, particularly for fabrics with a high stretch level. Consumers see "bagging and sagging" of the garment after long time wear. In these commercially available fabrics, the main body of the stretch fabric is formed only by one set of elastic corespun composite yarn. Elastic corespun yarn provides elasticity and stretch-recovery function to these fabrics.

Elastic core-spun yarns have a low modulus due to the inclusion of staple fiber in sheath and elastic fiber in core. The fabrics are easily extended during body movement, which provide comfort, fit and free movement benefit. However, when fabrics are over stretched out in some parts of the body, such as in knee, butt and waist, they can't quickly recovery to original size and shape. The garment shape and appearance are compromised by stretch function of the fabrics. The fabrics having improved recovery are still desired.

Most stretch woven fabrics are made with only one set of elastic yarns in the direction in which the stretch will exist. For example, corespun elastic yarns are commonly used as the filling yarn in order to make weft stretch fabrics. For stretch fabric, most elastic or elastomeric yarns are used in combination with relatively inelastic fibers, such as polyester, cotton, nylon, rayon or wool. However, for the purposes of this specification, such relatively inelastic fibers will be termed "hard" fibers.

U.S. Pat. No. 3,169,558 discloses a woven fabric with bare spandex in one direction and hard yarns in the other direction. However, the bare spandex must be draw twisted in a separate process, and spandex can be exposed on fabric surface.

Great Britain Patent GB 15123273 discloses a warp-stretch woven fabric and process where pairs of warp yarns, each pair having bare elastomeric fibers and a secondary hard yarn, are passed in parallel and at different tensions through the same heald eyelet and dent. This fabric also suffers from the deficiency of spandex being visible on the face and back of fabric.

Japanese Published Application No. 2002-013045 discloses a process used to manufacture a warp-stretch woven fabric using both composite and hard yarns in the warp. The composite yarn comprises polyurethane yarn wrapped with a synthetic multifilament hard yarn and then coated with size material. The construction of the composite is that of the composite yarns represented in FIG. 3A and FIG. 3B, before coating with size material. The composite yarn is used in the warp in various proportions to a separate synthetic multifilament hard yarn in order to achieve the desired properties of stretch in the warp direction. This composite yarn and method were developed to manufacture warp-stretch fabrics, and to avoid difficulties in the weaving of weft-stretch fabrics. However, the elastic yarns have the same size as hard yarn and exposed on the fabric surface.

U.S. Pat. No. 6,659,139 describes a way to reduce grin through of bare elastomeric yarn in warp direction of twill fabric. However, the elastomeric yarns are used in bare form and slippage of the elastomeric yarn occurs after the garment is washed. The workable fabric structure window is narrow and the weaving efficiency is low.

A stretch fabric with separated elastic yarn system is disclosed in U.S. Pat. No. 7,762,287, where a rigid yarn is used to form the main body of fabrics. Elastic composite yarns are hidden inside fabrics and provide the stretch and recovery.

In U.S. Pat. No. 8,093,160, a rigid control filament is combined with elastic filaments, as core the core of a spun yarn. A limitation of this approach is the on the ability of the control filament to limit growth due to the control filament being wrapped around the elastic filament with staple sheath surface fiber.

SUMMARY OF THE INVENTION

There is a need to produce stretch woven fabrics, which have excellent recovery power, low growth, low shrinkage, and easy, process-friendly garment making. Ideally, these fabrics will avoid the deficiencies of previous fabrics such as "grin-through" of elastic fibers and more economical fabric production.

One aspect provides an article including a woven fabric including warp yarns and weft yarns, wherein at least one of either the warp yarns or the weft yarns includes:

(a) a corespun elastic base yarn having a denier and comprising staple fiber and an elastic fiber core; and (b) a separate control yarn selected from the group consisting of a single filament yarn, a multiple filament yarn, a composite yarn, and combinations thereof; having a denier greater than zero to about 0.8 times the denier of the corespun elastic base yarn;

wherein the woven fabric includes (1) a ratio of corespun base yarn ends to control yarn ends of up to about 6:1; or (2) a ratio of corespun base yarn picks to control yarn picks of up to about 6:1; or (3) both a ratio of corespun base yarn ends to control yarn ends of up to about 6:1; and a ratio of corespun base yarn picks to control yarn picks of up to about 6:1.

Another aspect provides a method for making an article comprising a woven fabric comprising weaving warp yarns and weft yarns, wherein at least one of either the warp yarns or the weft yarns includes:

(a) a corespun elastic base yarn having a denier and comprising staple fiber and an elastic fiber core; and (b) a separate control yarn selected from the group consisting of a single filament yarn, a multiple filament yarn, a composite yarn, and combinations thereof; having a denier greater than zero to about 0.8 times the denier of the corespun elastic base yarn;

wherein the woven fabric includes (1) a ratio of corespun base yarn ends to control yarn ends of up to about 6:1; or (2) a ratio of corespun base yarn picks to control yarn picks of up to about 6:1; or (3) both a ratio of corespun base yarn ends to control yarn ends of up to about 6:1; and a ratio of corespun base yarn picks to control yarn picks of up to about 6:1.

BRIEF DESCRIPTION OF THE FIGURES

The detailed description will refer to the following drawing, wherein like numerals refer to like elements and wherein:

FIG. 1 is an illustrated fabric structure with separate control yarn system.

DETAILED DESCRIPTION OF THE INVENTION

Elastomeric fibers are commonly used to provide stretch and elastic recovery in woven fabrics and garments. "Elastomeric fibers" are either a continuous filament (optionally a coalesced multifilament) or a plurality of filaments, free of diluents, which have a break elongation in excess of 100% independent of any crimp. An elastomeric fiber when (1) stretched to twice its length; (2) held for one minute; and (3) released, retracts to less than 1.5 times its original length within one minute of being released. As used in the text of this specification, "elastomeric fibers" means at least one elastomeric fiber or filament. Such elastomeric fibers include but are not limited to rubber filament, biconstituent filament and elastoester, lastol, and spandex. The terms "elastomeric" and "elastic" are used interchangeably throughout the specification.

"Spandex" is a manufactured filament in which the filament-forming substance is a long chain synthetic polymer comprised of at least 85% by weight of segmented polyurethane.

"Elastoester" is a manufactured filament in which the fiber forming substance is a long chain synthetic polymer composed of at least 50% by weight of aliphatic polyether and at least 35% by weight of polyester.

"Biconstituent filament" is a continuous filament comprising at least two polymers adhered to each other along the length of the filament, each polymer being in a different generic class, for example, an elastomeric polyetheramide core and a polyamide sheath with lobes or wings.

"Lastol" is a fiber of cross-linked synthetic polymer, with low but significant crystallinity, composed of at least 95 percent by weight of ethylene and at least one other olefin unit. This fiber is elastic and substantially heat resistant.

"Polyester bi-component filament" means a continuous filament comprising a pair of polyesters intimately adhered to each other along the length of the fiber, so that the fiber cross section is for example a side-by-side, eccentric sheath-core or other suitable cross-section from which useful crimp can be developed. The fabric made with this filament, such as Elasterell-p, PTT/PET bi-component fiber, has excellent recovery characteristics.

A "covered" elastomeric fiber is one surrounded by, twisted with, or intermingled with hard yarn. The covered yarn that comprises elastomeric fibers and hard yarns is also termed a "composite yarn" in the text of this specification. The hard-yarn covering serves to protect the elastomeric fibers from abrasion during weaving processes. Such abrasion can result in breaks in the elastomeric fiber with consequential process interruptions and undesired fabric non-uniformities. Further, the covering helps to stabilize the elastomeric fiber elastic behavior, so that the composite yarn elongation can be more uniformly controlled during weaving processes than would be possible with bare elastomeric fibers. The terms "composite yarn", and "composite elastic core yarn" are all used interchangeably throughout the specification.

The composite yarns include: (a) single wrapping of the elastomer fibers with a hard yarn; (b) double wrapping of the elastomer fibers with a hard yarn; (c) continuously covering (i.e., corespun or core-spinning) an elastomer fiber with staple fibers, followed by twisting during winding; (d) intermingling and entangling elastomer and hard yarns with an air jet; and (e) twisting an elastomer fibers and hard yarns together.

"Grin-through" is a term used to describe the exposure, in a fabric, of composite yarn to view. Grin-through can manifest itself as an undesirable glitter. If a choice must be made, low grin through on the face side is more desirable than low grin-through on the back side.

The stretch fabric of the some embodiments includes corespun elastic base weft yarn (called base weft) and control weft filament. In some embodiments, a fabric with unexpectedly high recovery properties was achieved, especially for high stretch fabrics. This was accomplished by the use of a control yarn in the weft. Those of skill in the art will recognize that where warp stretch is desired, the fabric may include elastic base yarn warp ends and control warp filaments. Accordingly, the warp yarns may include the corespun elastic base yarn and the separate control yarn or as an alternative, both the weft and the warp may each include both the corespun elastic base yarn and the separate control yarn. For the sake of simplicity and clarity, the fabrics of some aspects will be described where the separate yarn system is in the weft, however, it is understood that the separate yarn system (including both the corespun elastic base yarn and the separate control yarn) are present in only the warp or in both the warp and weft.

Some aspects provide stretchable, elastic fabrics and methods for making such fabrics that include providing the fabrics with a separate control yarn system (as shown in FIG. 1). The fabrics include a base elastic corespun yarn system 4 and control yarn system 6. The base yarn system 4 performs aesthetical, appearance, hand feel, stretch and recovery functions. The control yarn system 6 performs over-stretch protection function. The warp yarn 2 is shown as a cross-section in FIG. 1 and includes hard yarn and optionally an elastic yarn, including a composite elastic core yarn.

FIG. 1 (*a*) shows the invention fabric structure under normal relaxed state. Because the yarn diameter of control yarn 6 is much smaller than base corespun yarn, the control yarn 6 migrates into the center of fabric in relaxation steps during the finishing and dyeing process. Control yarn 6 stays in the central of fabric and is hidden inside the fabric by the adjacent elastic corespun base yarns 4, making the control yarn 6 not visible on the fabric surface. Therefore, most of control yarn 6 is not visible on the fabric surface. Core spun base yarn 4 dominates the surface of the fabric, appearance of the fabric, and feeling of the fabric on touch or handling. The mechanism of the separate control yarn 6 is to restrict over-stretch during wearing more effectively than the fabric without a control yarn or a fabric including a dual core filament. When an extension force exerted on the fabric, the fabric is only able to be stretched to L1 elongation. Due to the existence of the control yarn 6, the fabric cannot be stretched out further. Accordingly, fabric deformation stops at L1 elongation. For conventional fabric without control yarn 6 as shown in FIG. 1 (*c*), the fabric can be further and/or continually stretched under the same extension force with L2 elongation. The existence of control yarn 6 reduces the extra fabric deformation significantly (L3 as shown in FIG. 1). For most fabrics, most of the extra deformation is unrecoverable after the extension force is released resulting in growth in fabric size and "sagging and bagging" in the garment. This undesired fabric growth is observable by the wearer.

In addition to the benefit of preventing over-stretching, the control yarns 6 also provide higher recovery power to the fabrics. Filaments normally have higher extension modular and high recovery force when extended. The existence of control yarn 6 within fabric also helps to increase the extension modular of whole fabric. During stretching fabric out, control yarn 6 contributes higher holding force and recovery force to fabrics in extension direction. This is especially observed where the yarn that provides control is also an elastic yarn such as polyester bicomponent known as elasterelle-p in the United States, elasto multi-ester in Europe, and available under the trade name LYCRA® T400® fiber by INVISTA S.àr.l. (Wichita, Kans.).

Another advantage of these fabrics is that a heat setting step is not required to provide the fabric with dimensional stability (i.e., the fabric edges are substantially free of edge curl and the fabric maintains the shape as woven without distortion caused by the retractive force of the elastic yarn). Control yarn 6 increases the friction resistance force during fabric washing and finishing processes. Accordingly, the fabric has lower shrinkage and better dimensional stability.

In one aspect, the elastic corespun base yarn is covered elastomeric fiber such as spandex yarn, where the core includes spandex. The bare spandex yarn (prior to covering to form the composite yarn) may be from about 11 dtex to about 444 dtex (denier—about 10 D to about 400 D), including 11 dtex to about 180 dtex (denier 10 D to about 162 D). The spandex yarn is covered with one or more hard yarns, with yarn count from 6 to 120 Ne. During the covering process, the spandex yarn is drafted between 1.1× to 6× its original length.

The elastomeric fiber content with the base corespun yarn may be from about 0.1% to about 20%, including from about 0.5% to about 15%, and about 5% to about 10% based on the weight of the yarn. Elastomeric fiber content within the fabric may be from about 0.01% to about 5% by weight based on the total fabric weight, including from about 0.1% to about 3%. Also provided are fabrics and a method for making a stretch fabric where various weave patterns can be applied, including plain, poplin, twill, oxford, dobby, sateen, satin and combinations thereof.

The staple sheath fibers in elastic corespun yarn can be natural fibers, such as, cotton, wool, linen or silk or synthetic, such as polyester, nylon, olefin, and combinations thereof. They also can be the staple man made or synthetic fibers of mono component poly(ethylene terephthalate) and poly(trimthylene terephthalate) fiber (polyester), polycaprolactam fiber, poly(hexamethylene adipamide) fibers (nylon), acrylic fibers, modacrylic, acetate fibers, rayon fibers, Nylon and combinations thereof.

The fabrics of some aspects include a control yarn that is substantially invisible on the fabric surface; meaning that it is not visually observed on the fabric surface. This may be accomplished in part by including an elastic corespun base yarn that heavier denier than the control yarn. The ratio of yarn denier of base yarn to control yarn (the corespun base yarn ends or picks to control yarn ends or picks, respectively), from about 2:1 to about 20:1 including from about 3:1 to about 10:1, also including from about 1:1 to about 4:1.

The control yarn can be any kinds of rigid filament known to those in the art. Suitable control yarn include filaments formed of virtually any fiber-forming polymers, including but not limited to, polyamides (e.g. nylon 6, nylon 6,6, nylon 6,12 and the like), polyesters, polyolefins (e.g. polypropylene, polyethylene) and the like, as well as mixtures and copolymers of the same. The control filament may be a filament yarn having a high shrinkage selected from the group consisting of fully drawn yarn, textured yarn, partially oriented yarn, and combinations thereof. One suitable yarn includes polyester filaments, such as those commercially available as textured polyester from about 15 D to 150 D.

Polyester bi-component filament, such as, elasterell-p, PET/PTT bi-component, are also suitable to be used as also control yarn. Polyester bi-component filament has the advantage of also providing elasticity/stretch-recovery, in addition to providing control. The retraction power of the filament increases the recovery and stretch of the fabrics. The control yarn may be polyester bicomponent filament having a linear density of about 10 denier to about 450 denier.

An elastic composite filament also can be used as the separate control yarn. The control yarns with elasticity not only prevent fabric from over-stretching, but also can increase the recovery power of fabrics. The elastic control yarn includes various elastic composite filaments, such as single wrapping of the spandex with a filament; double wrapping of spandex with filament; and entangling or intermingling spandex with filaments through an air jet; and twisting of an elastic fiber such as spandex together with a filament hard fiber. The spandex denier (or denier of another elastic fiber) could be from about 11 dtex to about 165 dtex (denier—about 10 D to about 150 D) with draft between 1.1× to 6× its original length.

Unexpectedly, it was also found that the filaments with higher shrinkage, such as polyester, nylon and POY yarns could be used as control yarns effectively. High shrinkage filaments contract more during fabric finishing forces under heat and hot water. They show shorter length that corespun base yarn inside the fabric, which has better over-stretch protection. It is found that several control yarns provide opportunity to add extra function into fabrics. Such as polyester and nylon filament will increase the tenacity of the fabrics and improve the wrinkle resistant abilities. Special function filaments can also be introduced. For example, COOLMAX® fiber that helps absorb moisture from body and quick deliver to outside or conductible fiber that conducts the electricity may be used. The filaments with antibiotic and micro-capsules also can be used to provide the fabrics with body care, freshness and easy care performances.

The linear density of the control yarn useful in some aspects can range from about 15 denier (D) (16.5 dtex) to about 450 denier, including about 15 denier to about 300 denier (330 dtex), including from about 30 denier to 100 denier (33 dtex to 110 dtex). When the ratio of yarn denier between core spun base yarn and control yarn is higher than 0.33, the fabric has no substantial grin through. After the finishing process, control yarn migrate into the center of fabric, are invisible and untouchable. The control yarn may be combined with the elastic corespun base yarn during the weaving warping, beaming or sizing operations. The fabric finishing includes one or more steps selected from the group consisting of: scouring, bleaching, mercerization, dyeing, drying and compacting and any combination of such steps.

The content of elastic corespun base yarn may be about 65% or more by weight based on the weight of the all weft yarns. For a fabric having a weight of 5 oz/yard$^2$ and heavier, an acceptable elastomeric fiber content in the weft may be about 10% or lower of total weft yarn weight, including from about 2% to about 8%, and about 4% or less of total fabric weight. For the fabrics weighing less than 5 oz/yard$^2$, an acceptable elastomeric fiber content in weft may be less than about 12% of total weft yarn weight, including from about 3% to about 10%, and less than 5% of total fabric weight.

The fabrics of some embodiments may have an elongation from about 10% to about 45% in the warp or/and weft direction, depending on which direction the elastic fibers are included. The fabrics may have shrinkage of about 10% or less after washing. The stretch woven fabric may have an excellent cotton hand feel. Garments may be prepared from the fabrics described herein.

The warp yarn can be the same as, or different from, the weft yarns. The fabric can be weft-stretch only, or it can be bi-stretch, in which useful stretch and recovery properties are exhibited in both the warp and weft directions. Such warp stretch can be provided by bicomponent filament yarn, spandex, melt-spun elastomer, and the like.

When the warp yarns include a elastic yarn, they can include a second yarn (optionally a spun staple yarn), for example, in a pick- and pick or co-insertion construction. When an elastic yarn or fiber is included in the warp, including when the elastic yarn is a elastic base yarn, the amount of elastic yarn present in the warp may be from about 0.2% to about 5% by weight of the weft yarns.

The ratio of elastic corespun base weft yarn to control weft filament may be from about 1:1 to about 8:1. Other acceptable rations of the base picks to control yarn picks may be from about 1:1 to about 6:1 and about 2:1 to about 6:1. If the ratio is too high, the control yarn can be excessively exposed to the surface of the fabric, resulting in undesirable visual and tactile aesthetics. When the ratio is too low, the fabric can have undesirably low stretch and recovery properties.

The control yarns float over no more than 6 ends on the face side of fabric, depending on the weaving pattern. The control yarn may further not float over more than 5 picks or 4 picks to exclude base corespun yarn from having surface visibility. On the back side of the fabric, base weft may float over no more than 6 picks, no more than 5, 4, or 3 picks depending on the weaving pattern. When the base weft float is too long, the fabric can have an uneven surface and snagging. Also, grin-through can become unacceptable.

The control yarn can be present in any desired amount for example from about 5 to about 20 weight percent based on total fabric weight when control yarn is present in the warp (i.e., when the control yarn only present in the weft). When control yarn is present in both warp and weft, the control yarn may be present in a greater amount, for example, from about 10% to 40% by weight.

In one embodiment of the method of this invention, the corespun base yarn is combined together with control yarn during weaving operation. The warp beam of corespun base yarn and the warp beam of control yarn are made separately. The weaving machines with double beam ability are necessary. Normally, the corespun base yarn beam is located in the bottom on loom. The beam with control yarn is put on the top. Both base yarns and control yarns are fed from the beam and pass over a whip roll or rollers, which control yarn tension variations during weaving motions. The yarns are then directed through drop wires, heddles, and a read. Base yarn and core yarns can be in the same dent. All the warp yarns weaving alike in a designed repeat occupy a given harness. The reed establishes the width of the warp sheet and equal spacing of the yarn before weaving. It also is the mechanism used for pushing (beating-up) each inserted filling yarn (pick) into the body of fabric at the "fell of the cloth". The fell is the point where yarns become fabric. At this point, the base corespun yarn, control yarns and weft are in fabric form and ready to be collected on a cloth roll.

The corespun base yarn and control yarn also can be combined together during a warping operation. The processing procedure is shown in FIG. 7. Warping is the process of transferring multiple yarns from individual yarn package onto a single package assembly. Normally, yarns are collected in a sheet form where the yarns lie parallel to each other and in the same plane onto a beam, which is a cylindrical barrel with side flanges. The supply yarn packages are placed on spindles, which are located in a frame work called a creel. Core yarn and base yarn are put on the creel in certain position. Then they are pulled out and form a mixed sheet in required pattern. Finally, they are wound into beam together (FIG. 8).

Control yarns are mixed with corespun base yarn within sizing machine. At the back end of the slasher range, the section beams from the beaming process are creeled. The yarn from each beam will be pulled over and combined with the yarns from the other beams to form multiple sheets of yarns.

The combination of a base yarn and control yarn structures also can be used in the weft direction. During the weaving process, core spun base yarn and control yarn are inserted into fabrics as fill yarns. They can be introduced by single pick or double pick during one weft insertion (co-insertion). In single pick insertion, one pick yarn is introduced into fabric per beat. In co-insertion, two weft yarns (corespun base yarn and control yarn) are inserted together in the single beat continuously. Two feeders may be used for better tension control individually: One weft feeder for corespun base yarn; another feeder for control yarn. Two yarns are combined together in the main air nozzle of air jet loom or rapier dampers of rapier loom. Two fillings are inserted simultaneously. In some cases, only one feeder is used. The corespun base yarn and control yarn are fed into one feeder and then are inserted into loom simultaneously. Different tension devices are used before the feeder for the corespun base and control yarns.

Air jet loom, rapier loom, projectile loom, water jet loom and shuttle loom can be used. The weaving pattern of corespun base yarn and control yarn can be the same or different.

Dyeing and finishing process are important in producing a satisfactory fabric. The fabric can be finished in continuous range processes and the piece dye jet processes. Conventional equipment found in a continuous finishing plant and piece dye factories are usually adequate for processing. The normal finishing process sequences include preparation, dyeing and finishing. In preparation and dyeing process, including in singing, desizing, scouring, bleaching, mercerizing and dyeing, normal processing methods for elastic wovens are usually satisfactory.

Finishing processing is a more critical step in producing satisfactory inventive fabrics with bi-stretch (i.e., fabrics that stretch in weft as well as warp direction). Finishing is conducted normally in a tenter frame. The main purposes of the finishing process in tenter frame are to pad and cure the softener, wrinkle resistant resin and to heatset the spandex.

The control yarn is substantially invisible on the fabric surface after the fabric is finished. FIG. 1 (*a*) shows the structure. Because of lower crimp height of control yarn 6, and the lean of corespun base yarns 4 toward control yarn, control yarn is located at the center of fabric, basically/ essentially covered by surface yarns 2 and 6 and invisible and untouchable at the fabric surface.

It is also was found that the heatset process may not be required for this stretch woven fabric. The fabric meets many end use specifications without heat setting. The fabric maintains shrinkage of less than about 10% even without heatset. Heat setting "sets" spandex in an elongated form. This is also known as re-deniering, wherein a spandex of higher denier is drafted, or stretched, to a lower denier, and then heated to a sufficiently high temperature, for a sufficient time, to stabilize the spandex at the lower denier. Heat setting therefore means that the spandex permanently changes at a molecular level so that recovery tension in the stretched spandex is mostly relieved and the spandex becomes stable at a new and lower denier. Heat setting temperatures for spandex are generally in the range of 175° C. to 200° C. Heat setting conditions for conventional spandex are for about 45 seconds or more at about 190° C.

In conventional fabrics, if heat setting is not used to "set" the spandex, the fabric may have high shrinkage, excessive fabric weight, and excessive elongation, which may result in a negative experience for the consumer. Excessive shrinkage during the fabric finish process may result in crease marks on the fabric surface during processing and household washing. Creases that develop in this manner are frequently very difficult to remove by ironing.

By eliminating the high-temperature heat setting step in the process, the new process may reduce heat damage to certain fibers (i.e. cotton) and thus may improve the handle of the finished fabric. The fabrics of some embodiments may be prepared in the absence of a heat setting step including where the fabrics will be prepared into garments. As a further benefit, heat sensitive hard yarns can be used in the new process to make shirting, elastic, fabrics, thus increasing the possibilities for different and improved products. In addition, the shorter process has productivity benefits to the fabric manufacturer.

Analytical Methods:

Woven Fabric Elongation (Stretch)

Fabrics are evaluated for % elongation under a specified load (i.e., force) in the fabric stretch direction(s), which is the direction of the composite yarns (i.e., weft, warp, or weft and warp). Three samples of dimensions 60 cm×6.5 cm were cut from the fabric. The long dimension (60 cm) corresponds to the stretch direction. The samples are partially unraveled to reduce the sample widths to 5.0 cm. The samples are then conditioned for at least 16 hours at 20° C.+/−2° C. and 65% relatively humidity, +/−2%.

A first benchmark was made across the width of each sample, at 6.5 cm from a sample end. A second benchmark was made across the sample width at 50.0 cm from the first benchmark. The excess fabric from the second benchmark to the other end of the sample was used to form and stitch a loop into which a metal pin could be inserted. A notch was then cut into the loop so that weights could be attached to the metal pin.

The sample non-loop end was clamped and the fabric sample was hung vertically. A 17.8 Newton (N) weight (4 LB) is attached to the metal pin through the hanging fabric loop, so that the fabric sample is stretched by the weight. The sample was "exercised" by allowing it to be stretched by the weight for three seconds, and then manually relieving the force by lifting the weight. This cycle was carried out three times. The weight was allowed then to hang freely, thus stretching the fabric sample. The distance in millimeters between the two benchmarks was measured while the fabric was under load, and this distance is designated ML. The original distance between benchmarks (La, unstretched distance) was designated GL. The % fabric elongation for each individual sample as calculated as follows:

$$\%\ \text{Elongation}\ (E\%)=((ML-GL)/GL)\times 100$$

The three elongation results were averaged for the final result.

Woven Fabric Growth (Unrecovered Stretch)

After stretching, a fabric with no growth would recover exactly to its original length before stretching. Typically, however, stretch fabrics will not fully recover and will be slightly longer after extended stretching. This slight increase in length is termed "growth."

The above fabric elongation test must be completed before the growth test. Only the stretch direction of the fabric was tested. For two-way stretch fabric both directions were tested. Three samples, each 55.0 cm×6.0 cm, were cut from the fabric. These were different samples from those used in the elongation test. The 55.0 cm direction should correspond to the stretch direction. The samples were partially unraveled to reduce the sample widths to 5.0 cm. The samples were conditioned at temperature and humidity as in the above elongation test. Two benchmarks exactly 50 cm apart were drawn across the width of the samples.

The known elongation % (E %) from the elongation test was used to calculate a length of the samples at 80% of this known elongation. This was calculated as $$E(\text{length})\ \text{at}\ 80\%=(E\%/100)\times 0.80\times L,$$

where L was the original length between the benchmarks (i.e., 50.0 cm). Both ends of a sample were clamped and the sample was stretched until the length between benchmarks equaled L+E (length) as calculated above. This stretch was maintained for 30 minutes, after which time the stretching force was released and the sample was allowed to hang freely and relax. After 60 minutes the % growth was measured as $$\%\ \text{Growth}=(L2\times 100)/L,$$

where L2 was the increase in length between the sample benchmarks after relaxation and L was the original length between benchmarks. This % growth was measured for each sample and the results averaged to determine the growth number.

Woven Fabric Shrinkage

Fabric shrinkage was measured after laundering. The fabric was first conditioned at temperature and humidity as in the elongation and growth tests. Two samples (60 cm×60 cm) were then cut from the fabric. The samples were taken at least 15 cm away from the selvage. A box of four sides of 40 cm×40 cm was marked on the fabric samples.

The samples were laundered in a washing machine with the samples and a loading fabric. The total washing machine load was 2 kg of air-dried material, and not more than half the wash consisted of test samples. The laundry was gently washed at a water temperature of 40° C. and spun. A detergent amount of 1 g/l to 3 g/l was used, depending on water hardness. The samples were laid on a flat surface until dry, and then they were conditioned for 16 hours at 20° C.+/−2° C. and 65% relative humidity +/−2% rh.

Fabric sample shrinkage was then measured in the warp and weft directions by measuring the distances between markings. The shrinkage after laundering, C %, was calculated as $$C\%=((L1-L2)/L1)\times 100,$$

where L1 was the original distance between markings (40 cm) and L2 is the distance after drying. The results are averaged for the samples and reported for both weft and warp directions. Negative shrinkage numbers reflect expansion, which was possible in some cases because of the hard yarn behavior.

Fabric Weight

Woven Fabric samples were die-punched with a 10 cm diameter die. Each cut-out woven fabric sample was weighed in grams. The "fabric weight" was then calculated as grams/square meters.

EXAMPLES

The following examples demonstrate the present invention and its capability for use in manufacturing a variety of light weight fabrics. The invention is capable of other and different embodiments, and its several details are capable of modifications in various apparent respects, without departing from the scope and spirit of the present invention. Accordingly, the examples are to be regarded as illustrative in nature and not as restrictive.

For each of the following 14 examples, 100% cotton open end spun yarn or ring spun yarn was used as the warp yarn. For denim fabrics, this included two different count yarns: 7.0 Ne OE yarn and 8.5 Ne OE yarn with irregular arrangement pattern. The yarns were indigo dyed in rope form before beaming. Then, they were sized and made the weaving beam. For bottom weight fabrics, the warp yarn are 20 Ne 100% cotton ring spun yarn. They were sized and place formed the weaving beam.

Several cotton corespun elastic yarns were used as base yarn in weft direction. Various filaments, including polyester textured filament, polyester/LYCRA® spandex fiber, LYCRA® T400® Elasterell-p fiber were used as control yarn. Table 1 lists the materials and process ways that were used to make the control yarn for each example. Table 2 shows the detail fabric structure and performance summary for each fabric. Lycra® spandex and LYCRA® T400® Elasterell-p fiber are available from Invista, s. à. r. L., Wichita, Kans. For example, in the column headed Spandex 40 D means 40 denier; 3.5× means the draft of the Lycra® imposed by the core spinning machine (machine draft). For example, in the column headed 'Hard Yarn', 40's is the linear density of the spun yarn as measured by the English Cotton Count System. The rest of the items in Table 1 are clearly labeled.

Stretch woven fabrics were subsequently made, using the core spun base yarn of each example in Table 1 and control yarn. Table 2 summarizes the yarns used in the fabrics, the weave pattern, and the quality characteristics of the fabrics. Some additional comments for each of the examples are given below. Unless otherwise noted, the fabrics were woven on a Donier air-jet or rapier loom. Loom speed was 500 picks/minute. The widths of the fabric were about 76 and about 72 inches in the loom and greige state respectively. The loom has double weaving beam capacity. Control yarn is put on the top of loom and base yarn is put on the bottom of loom.

Each greige fabric in the examples was finished by a jiggle dye machine. Each woven fabric was pre-scoured with 3.0 weight % Lubit®64 (Sybron Inc.) at 49° C. for 10 minutes. Afterwards it was de-sized with 6.0 weight % Synthazyme® (Dooley Chemicals. LLC Inc.) and 2.0 weight % Merpol® LFH (E. I. DuPont Co.) for 30 minutes at 71° C. and then scoured with 3.0 weight % Lubit® 64, 0.5 weight % Merpol® LFH and 0.5 weight % trisodium phosphate at 82° C. for 30 minutes. Fabric finishing was followed by dry in a tente frame at 160° C. for 1 minutes. No heat setting was performed on these fabrics.

TABLE 1

| | control filament in weft | | | | |
|---|---|---|---|---|---|
| Example | Control filament | Hard Filament | Elastic filament | Elastic fiber Draft | composite form |
| 1C | No, no innovation sample | No | No | No | No |
| 2 | 70D/72f polyester filament | 70D/72F polyester | | | textured |
| 3 | 40D/34f Nylon/40D Lycra ® single covered | 40D/34f textured nylon | 40D LYCRA ® spandex fiber | 3.5X | air covered |
| 4 | 75D/34f LYCRA ® T400 ® fiber | | 75D/34f LYCRA ® elastrell-p fiber | | bare filament |
| 5C | No, no innovation sample | No | No | No | No |
| 6 | 70D/72f polyester filament | 70D/72F polyester | No | No | textured |
| 7C | No, no innovation sample | No | No | No | No |
| 8 | 40D/34f Nylon/40D Lycra ® single covered | 40D/34f textured nylon | 40D LYCRA ® spandex fiber | 3.5X | air covered |
| 9 | 75D/34f LYCRA ® T400 ® fiber | | 75D/34f LYCRA ® elastrell-p fiber | | bare filament |
| 10 | 150D/68f LYCRA ® T400 ® fiber | | 150D/68f LYCRA ® elasterell-p fiber | | bare filament |
| 11C | No, no innovation sample | No | No | No | No |
| 12 | 75D/34f LYCRA ® T400 ® fiber | | 75D/34f LYCRA ® elasterell-p fiber | | bare filament |

TABLE 1-continued

| control filament in weft | | | | | |
|---|---|---|---|---|---|
| Example | Control filament | Hard Filament | Elastic filament | Elastic fiber Draft | composite form |
| 13 | 150D/68f LYCRA ® T400 ® fiber | | 150D/68f LYCRA ® elasterell-p fiber | | bare filament |
| 14 | 40D/34f Nylon/40D Lycra ® single covered | 40D/34f textured nylon | 40D LYCRA ® spandex fiber | 3.5X | air covered |

TABLE 2

| Fabric Example List | | | | | | |
|---|---|---|---|---|---|---|
| Example | Warp yarn | Corespun elastic base yarn in weft | Control filament in weft | Corespun Base weaving pattern | control filament weave pattern | Fabric on loom (warp EPI × weft PPI) |
| 1C | 40'/2 cotton ring spun yarn | 20s cotton/40D LYCRA ® fiber CSY | No, no innovation sample | 3/1 RHT | | 96 × 56 |
| 2 | 40'/2 cotton ring spun yarn | 20s cotton/40D LYCRA ® fiber CSY | 70D/72f polyester filament | 3/1 RHT | 3/1 RHT | 96 × 50 |
| 3 | 40'/2 cotton ring spun yarn | 20s cotton/40D LYCRA ® fiber CSY | 40D/34f Nylon/40D Lycra ® air covered | 3/1 RHT | 3/1 RHT | 96 × 50 |
| 4 | 40'/2 cotton ring spun yarn | 20s cotton/40D LYCRA ® fiber CSY | 75D/34f LYCRA ® T400 ® fiber | 3/1 RHT | 3/1 RHT | 96 × 50 |
| 5C | 40'/2 cotton ring spun yarn | 18s cotton/70D LYCRA ® fiber CSY | No, no innovation sample | 3/1 RHT | | 96 × 54 |
| 6 | 40'/2 cotton ring spun yarn | 18s cotton/70D LYCRA ® fiber CSY | 70D/72f polyester filament | 3/1 RHT | 3/1 RHT | 96 × 49 |
| 7C | 7.0' OE + 8.4' OE cotton indigo | 12s cotton/70D LYCRA ® fiber CSY | No, no innovation sample | 3/1 RHT | | 64 × 44 |
| 8 | 7.0' OE + 8.4' OE cotton indigo | 12s cotton/70D LYCRA ® fiber CSY | 40D/34f Nylon/40D Lycra ® air covered | 3/1 RHT | 3/1 RHT | 64 × 40 |
| 9 | 7.0' OE + 8.4' OE cotton indigo | 12s cotton/70D LYCRA ® fiber CSY | 75D/34f LYCRA ® T400 ® fiber | 3/1 RHT | 3/1 RHT | 64 × 40 |
| 10 | 7.0' OE + 8.4' OE cotton indigo | 12s cotton/70D LYCRA ® fiber CSY | 150D/68f LYCRA ® T400 ® fiber | 3/1 RHT | 3/1 RHT | 64 × 38 |
| 11C | 7.0' OE + 8.4' OE cotton indigo | 9.5s cotton/40D LYCRA ® fiber CSY | No, no innovation sample | 3/1 RHT | | 64 × 39 |
| 12 | 7.0' OE + 8.4' OE cotton indigo | 9.5s cotton/40D LYCRA ® fiber CSY | 75D/34f LYCRA ® T400 ® fiber | 3/1 RHT | 3/1 RHT | 64 × 37 |
| 13 | 7.0' OE + 8.4' OE cotton indigo | 9.5s cotton/40D LYCRA ® fiber CSY | 150D/68f LYCRA ® T400 ® fiber | 3/1 RHT | 3/1 RHT | 64 × 35 |
| 14 | 7.0' OE + 8.4' OE cotton indigo | 9.5s cotton/40D LYCRA ® fiber CSY | 40D/34f Nylon/40D Lycra ® single covered | 3/1 RHT | 3/1 RHT | 64 × 37 |

| Example | Finshed fabric Width, inch | Finished Fabric Weight OZ/Y^2 | Fabric Stretch in weft % | Fabric Growth in weft % | Fabric Shrinkage % (Warp × Weft) |
|---|---|---|---|---|---|
| 1C | 52.3 | | | | |
| 2 | 52.5 | | | | |
| 3 | 51.3 | | | | |
| 4 | 51.8 | | | | |
| 5C | 52.1 | | | | |
| 6 | 52.9 | | | | |
| 7C | 57 | 12.328 | 21.9 | 3.5 | −8.98 × −10.01 |
| 8 | 52 | 14.42 | 34.7 | 3.1 | −9.75 × −14.43 |

TABLE 2-continued

| Fabric Example List | | | | | |
|---|---|---|---|---|---|
| 9 | 54 | 13.273 | 23.8 | 2.7 | −9.11 × −10.20 |
| 10 | 53 | 12.620 | 22.0 | 2.3 | −9.77 × −9.65 |
| 11C | 57 | 12.920 | 25.3 | 3.0 | −8.98 × −11.99 |
| 12 | 54 | 13.296 | 23.9 | 2.7 | −9.79 × −11.20 |
| 13 | 54 | 13.785 | 23.9 | 2.6 | −10.29 × −10.81 |
| 14 | 53 | 14.203 | 33.7 | 2.3 | −10.33 × −14.10 |

Example 1C: Typical Stretch Woven Bottom Weight Fabric

This is a comparison example, not according to the invention. The warp yarn was 40/2 Ne count of ring spun yarn. The weft yarn was 20 Ne cotton with 40 D Lycra® core spun yarn. Lycra® draft is 3.5×. This weft yarn was a typical stretch yarn used in typical stretch woven khakis fabrics. Loom speed was 500 picks per minute at a pick level 56 Picks per inch. Table 2 summarizes the test results. The test results show that after finishing, this fabric had weight ($g/m^2$), stretch (%), width (52.3 inch), weft wash shrinkage (%). All these data indicate that this combination of stretch yarns and fabric construction caused high fabric growth.

Example 2: Stretch Fabric with Control Yarn in Weft

This sample had the same fabric structure as in example 1C. The only difference was the use of control yarn in weft: 70 D/72 f polyester textured filament. The warp yarn was 40/2 Ne ring spun cotton. The corespun base yarn in weft was 20 Ne cotton/40 D Lycra® core spun yarn. The loom speed was 500 picks/minute at 70 picks per inch. Table 2 summarizes the test results. It is clear that this sample had lower fabric growth level.

Example 3: Stretch Fabric with Elastic Control Yarn in Weft

This sample had the same fabric structure as in example 1C. The only difference was the use of control yarn in weft: 40 D/34 f Nylon/40 D Lycra® air covered. The warp yarn was 20 Ne 100% cotton ring spun yarn. The weft corespun base yarn was 20 Ne cotton/40 D Lycra® T162C core spun yarn (drafted to 3.5×). The ratio of corespun base yarn to control yarn in weft is 1:1. Two weft yarns are inserted into fabric during weaving through co-insertion method. Two weft feeders are used with different insertion tensions. 3/1 twill weaving pattern was applied for bother corespun base yarn and control yarn. The finished fabric had weight ($g/m^2$), % stretch and % growth in the weft direction. It is clearly shows, control yarn increase the fabrics stretch level while reducing the fabric growth.

Example 4: Stretch Fabric with LYCRA® T400® Fiber Control Yarn in Weft

This sample had the same fabric structure as in example 1C. The difference was the use of control yarn in weft: 75 D/34 f LYCRA® T400® Elasterell-p fiber. This fabric used the same warp and weft yarn as Example 1. Also, the weaving and finishing process were the same as Example 1. Table 2 summarizes the test results. We can see that this sample had good stretch (21.8%), good weft direction wash shrinkage (4.4%) and good fabric growth. The fabric appearance and handle was excellent.

Example 5C: Conventional Stretch Bottom Weight Fabric

This fabric is convention stretch fabric as control, no innovation sample. The warp yarn was 20 cc ring spun cotton, and the weft yarn was 18 Ne cotton/70 D Lycra® ® core spun yarn. The Lycra® draft in the core spun yarn was 3.8×. The loom speed was 500 picks/minute at 54 picks per inch.

Example 6: Stretch Fabric with Control Yarn

This sample had the same fabric structure as in example 5C. The only difference was the use of control yarn in weft: 70 D/72 f polyester textured filament. The corespun elastic weft yarn was 18 Ne cotton core spun with 70 D Lycra® spandex held at 3.8× draft. The warp yarn was 20 Ne 100% cotton ring spun yarn. The Fabric had very low growth in weft. This sample further confirms that adding control yarn can produce high performance stretch fabrics with low growth.

Example 7C: Conventional Stretch Denim Fabric

The warp yarn was 7.0 Ne count and 8.4 Ne count mixed open end yarn. The warp yarn was indigo dyed before beaming. The weft yarn is 12 Ne core spun yarn with 70 D Lycra® spandex. Lycra® draft is 3.8×. This sample is not an innovation fabric. Loom speed was 500 picks per minute at a pick level 44 Picks per inch. Table 2 summarizes the test results. The test results show that after washing, this fabric had weight (12.3 $OZ/Y^2$), 21.9% weft stretch and 3.5% growth in weft.

Example 8: Stretch Denim with Control Yarn

This example had the same warp yarn and same fabric structure as Example 7C, except adding control yarn for weft yarn. 12 Ne cotton/70 D Lycra® core spun yarn is used as corespun base yarn in weft. 40 D/34 f Nylon/40 D Lycra® air covered is used as control yarn. The LYCRA® fiber was drafted 3.5× during covering process. During weaving, both corespun base weft and control yarn weft yarn are the yarns are inserted into fabric as filling yarn. Donier Air jet loom is used. All these data indicate that this combination of core stretch base yarn and control yarn and fabric construction can produce good fabric stretch and growth. Fabric has no grin-through, control yarn cannot be seen from both surface and back.

Table 2 lists the fabric properties. The fabric made from such yarn exhibited good cotton hand, good stretch (34.7%) and good recovery (3.1%) growth.

Example 9: Stretch Denim with Control Yarn

This example had the same warp yarn and same fabric structure as Example 7C, except adding control yarn for weft yarn. 75 D34 f LYCRA® T400® Elasterell-p fiber is control yarn. 12 Ne cotton/70 D spandex Lycra® core spun yarn is used as corespun base yarn in weft. Both corespun base yarn and control yarn LYCRA® T400® fiber was 3 up and 1 down weaving pattern. The warp surface yarn was 7.0 Ne count and 8.4 Ne count mixed open end yarn. The warp yarn was indigo dyed before beaming. The loom speed was 500 picks/minute at 40 picks per inch. Table 2 summarizes the test results. It is clear that this sample had good stretch (weft 23.8%), and lower growth (2.7%) than control sample Example 7C (3.5%).

Example 10: Stretch Denim with LYCRA® T400® Fiber Control Yarn

This fabric used the same warp and weft yarn as Example 9. Also, the weaving and finishing process was the same as Example 9, but its control yarn is 150 D/68 f LYCRA® T400® Elasterell-p fiber. Table 2 summarizes the test results. We can see that this sample had weight (12.62 Oz/Y^2), good stretch (22.0%), and small growth (2.3%) than control Example 7C. The fabric appearance and handle was excellent.

Example 11C: Stretch Denim (Control Sample)

This is another comparison sample, not according to the invention. The warp surface yarn was 7.0 Ne count and 8.4 Ne count mixed open end yarn. The warp yarn was indigo dyed before beaming. The weft yarn was 9.5 Ne cotton/40 D LYCRA® Fiber®. This weft yarn is inserted into fabric at 39 picks/inch on the loom. 3/1 twill weaving pattern. Without heat setting, the sample had 25.3% stretch and 3.0% growth in the weft direction. It is a typical fabric for making weft stretch jean.

Example 12: Stretch Denim with LYCRA® T400® Elasterell-p Fiber

The fabric structure and finishing process are the sample as Example 110, except 75 D/34 f LYCRA® T400® Elasterell filament used as control yarn. 9.5 Ne cotton/40 D spandex Lycra® core spun yarn is used as corespun base yarn in weft. Both corespun base yarn and control yarn LYCRA® T400® fiber was 3 up and 1 down weaving pattern. The warp surface yarn was 7.0 Ne count and 8.4 Ne count mixed open end yarn. The warp yarn was indigo dyed before beaming. The loom speed was 500 picks/minute at 40 picks per inch. Table 2 summarizes the test results. It is clear that this sample had good stretch (weft 23.9%), and lower growth (2.7%) than control sample Example 11C (3.0%).

Example 13: Stretch Denim with Control Yarn

This example had the same warp yarn, corespun base weft, and fabric structure as Example 12, except 150 D LYCRA® T400® Elasterell-p fiber for control yarn. There is one end of control yarn among every corespun base yarn. 9.5 Ne cotton/40 D Lycra® core spun yarn is used as corespun base weft yarn. From Table 2, we can the fabric properties. Fabric growth is small than control example 110 (2.6% vs 3.0%).

Example 14: Stretch Denim with Polyester/Lycra® Air Covered Yarn

In this example the control yarn is 40 D/34 f nylon/40 D Lycra® air covered yarn. The ratio of control yarn Vs. corespun base yarn is 1:1. The denier ratio of corespun base yarn to control yarn is 560:106. The fabric has the same warp yarn, same corespun base weft yarn, and same fabric structure as in Example 12 and 13. The fabric made from such yarn exhibited higher stretch (33.7% vs. 23.9%), but low growth (2.3% vs. 2.7% and 2.6%). Generally, if the fabric has higher stretch, they have higher growth. But this fabric have high stretch and low growth, which show significant high recovery power.

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

The invention claimed is:

1. An article comprising a woven fabric comprising warp yarns and weft yarns, wherein at least one of either the warp yarns or the weft yarns includes:

(a) a corespun elastic base yarn having a denier and comprising staple fiber and an elastic fiber core; and (b) a separate control yarn comprising polyester bicomponent filament having a linear density of about 10 denier to about 450 denier;

wherein the woven fabric includes (1) a ratio of corespun base yarn ends to control yarn ends of up to about 6:1; or (2) a ratio of corespun base yarn picks to control yarn picks of up to about 6:1; or (3) both a ratio of corespun base yarn ends to control yarn ends of up to about 6:1; and a ratio of corespun base yarn picks to control yarn picks of up to about 6:1.

2. The article of claim 1, wherein the weft yarns include the corespun elastic base yarn and said separate control yarn.

3. The article of claim 1, wherein the warp yarns include the corespun elastic base yarn and said separate control yarn.

4. The article of claim 1, wherein both of the warp yarns and the weft yarns include the corespun elastic base yarn and said separate control yarn.

5. The article of claim 1, wherein at least one of either the warp yarns or the weft yarns has a ratio of the denier of the corespun base yarn to the denier of the separate control yarn of about 3:1 to about 10:1.

6. The article of claim 1, wherein the ratio of corespun base yarn ends or picks to control yarn ends or picks, respectively, of about 1:1 to about 4:1.

7. The article of claim 1, wherein the corespun base yarn comprises a fiber selected from the group consisting of wool, linen, silk, polyester, nylon, olefin, cotton, and combinations thereof.

8. The article of claim 1, wherein the amount of elastic fiber core in the corespun base yarn is about 0.5% to about 20% by weight of the warp or weft yarns.

9. The article of claim 1, wherein the elastic fiber core comprises spandex.

10. The article of claim 1, wherein the fabric has a weaving pattern selected from the group consisting of plain, twill, satin, and combinations thereof.

11. The article of claim 10, wherein the fabric weaving pattern for the corespun base yarn and the control yarn is the same.

12. The article of claim 1, wherein the fabric has stretch in the weft direction of about 10% to about 45%.

13. The article of claim 1, wherein the elastic fiber core has a linear density of about 10 denier to about 300 denier.

14. The article of claim 1, wherein said article is a garment.

15. A method for making an article comprising a woven fabric comprising weaving warp yarns and weft yarns, wherein at least one of either the warp yarns or the weft yams includes:

(a) a corespun elastic base yarn having a denier and comprising staple fiber and an elastic fiber core; and (b) a separate control yarn comprising polyester bicomponent filament having a linear density of about 10 denier to about 450 denier;

wherein the woven fabric includes (1) a ratio of corespun base yarn ends to control yarn ends of up to about 6:1; or (2) a ratio of corespun base yarn picks to control yarn picks of up to about 6:1; or (3) both a ratio of corespun base yarn ends to control yarn ends of up to about 6:1; and a ratio of corespun base yarn picks to control yarn picks of up to about 6:1.

16. The method of claim 15, wherein the corespun base yarn and the separate control yarn are joined during a warping process, a sizing process or during the weaving.

17. The method of claim 15, wherein the corespun base yarn is joined with the separate control yarn during the weaving through a co-insertion method.

18. The method of claim 15, where the fabric is finished in a piece dyeing or continuous dyeing process.

19. The method of claim 15, wherein said fabric is prepared in the absence of a heat setting process.

20. The method of claim 15 wherein said article is a garment.

* * * * *